US011274454B2

(12) United States Patent
Moller, Jr. et al.

(10) Patent No.: US 11,274,454 B2
(45) Date of Patent: Mar. 15, 2022

(54) TRACTION ENHANCED FLOOR TILE APPARATUS AND SYSTEM

(71) Applicant: Snap Lock Industries, Inc., Salt Lake City, UT (US)

(72) Inventors: Jorgen J. Moller, Jr., Sandy, UT (US); Jeremiah D. Shapiro, Layton, UT (US)

(73) Assignee: Snap Lock Industries, Inc., Salt Lake City, UT (US)

( * ) Notice: Subject to any disclaimer, the term of this patent is extended or adjusted under 35 U.S.C. 154(b) by 0 days.

(21) Appl. No.: 16/776,260

(22) Filed: Jan. 29, 2020

(65) Prior Publication Data

US 2021/0230882 A1 Jul. 29, 2021

(51) Int. Cl.

| | |
|---|---|
| ***E04B 1/70*** | (2006.01) |
| ***E04F 15/02*** | (2006.01) |
| *E04F 15/10* | (2006.01) |

(52) U.S. Cl.

CPC .. *E04F 15/02188* (2013.01); *E04F 15/02161* (2013.01); *E04F 15/02038* (2013.01); *E04F 15/10* (2013.01); *E04F 2290/00* (2013.01)

(58) Field of Classification Search

CPC . E04F 15/225; E04F 2201/0146; E04F 15/22; E04F 15/02038; E04F 2201/021; E04F 2201/0138; E04F 2201/0505; E01C 13/045; E01C 5/20; E01C 2201/12; E04B 5/43

USPC ... 52/302.1, 588.1, 745.05, 747.1, 177, 180, 52/302.3, 403.1, 506.1, 591.1, 506.01

See application file for complete search history.

(56) References Cited

U.S. PATENT DOCUMENTS

| | | | | | |
|---|---|---|---|---|---|
| 4,715,743 | A * | 12/1987 | Schmanski | A61H 3/066 | 404/9 |
| D385,974 | S * | 11/1997 | Berger | D25/163 | |
| 5,815,995 | A * | 10/1998 | Adam | E04F 15/02194 | 52/177 |
| D481,470 | S * | 10/2003 | Moller, Jr. | D25/163 | |
| 6,751,912 | B2 * | 6/2004 | Stegner | E01C 5/20 | 52/177 |
| 6,802,159 | B1 * | 10/2004 | Kotler | E01C 5/20 | 404/35 |
| 7,114,298 | B2 * | 10/2006 | Kotler | E01C 5/20 | 52/177 |
| 7,748,177 | B2 * | 7/2010 | Jenkins | E01C 5/20 | 52/177 |
| 7,757,449 | B2 * | 7/2010 | Portoles Ibanez | E04F 15/02016 | 52/384 |
| 8,397,466 | B2 * | 3/2013 | Jenkins | E04F 15/087 | 52/745.11 |
| 8,464,490 | B2 * | 6/2013 | Rapaz | E01C 5/001 | 52/592.1 |
| 9,010,060 | B2 * | 4/2015 | Rapaz | E04B 5/026 | 52/592.1 |

(Continued)

*Primary Examiner* — Chi Q Nguyen

(74) *Attorney, Agent, or Firm* — Dorsey & Whitney LLP

(57) ABSTRACT

A floor tile including a plurality of ribs defining an upper surface of the floor tile, each rib comprising a flat top configured to be parallel with a floor, wherein a thickness of each rib tapers toward the flat top. The flat top configuration increases wet weather traction by transitioning into a specific taper to decrease the surface tension so that water will effectively wet off and not affect traction. The understructure of the tile can have commercial load bearing capacity and built in channels for water drainage.

19 Claims, 6 Drawing Sheets

(56) References Cited

U.S. PATENT DOCUMENTS

| | | | | |
|---|---|---|---|---|
| 9,863,155 | B2 * | 1/2018 | Cerny | E04F 15/02038 |
| 9,944,017 | B2 * | 4/2018 | Neill | E04F 15/105 |
| 2002/0139074 | A1 * | 10/2002 | Smith | E04F 15/02<br>52/302.1 |
| 2004/0226242 | A1 * | 11/2004 | Moller, Jr. | E04F 15/02172<br>52/384 |
| 2005/0193669 | A1 * | 9/2005 | Jenkins | E04F 15/22<br>52/392 |
| 2006/0070314 | A1 * | 4/2006 | Jenkins | E04F 15/087<br>52/177 |
| 2007/0289244 | A1 * | 12/2007 | Haney | E01C 5/20<br>52/539 |
| 2008/0107781 | A1 * | 5/2008 | Carroll | B65D 81/3261<br>426/128 |
| 2009/0031658 | A1 * | 2/2009 | Moller, Jr. | E04F 15/105<br>52/403.1 |
| 2009/0235605 | A1 * | 9/2009 | Haney | E01C 13/045<br>52/588.1 |
| 2009/0266022 | A1 * | 10/2009 | Lin | E01C 5/001<br>52/506.1 |
| 2011/0185658 | A1 * | 8/2011 | Cerny | E01C 5/005<br>52/302.1 |
| 2017/0326833 | A1 * | 11/2017 | Neill | B29C 66/1122 |
| 2017/0367513 | A1 | 12/2017 | Loegering | |

* cited by examiner

TRACTION ENHANCED FLOOR TILE APPARATUS AND SYSTEM

TECHNICAL FIELD

The present disclosure relates generally to floor tiles. More particularly, the present disclosure relates to a traction enhanced floor tile comprising a plurality of supporting ribs.

BACKGROUND

Floor tiles are used for a variety of purposes, including utilitarian and aesthetic purposes. Floor tiles are often used in industrial and manufacturing settings. For example, floor tiles can be used as a support surface in a workspace or to protect the surface beneath the tiles from various forms of damage. Floor tiles can also be used to accentuate an object displayed on top of the tiles. Floor tiles typically comprise individual modular panels that are placed on the ground either permanently or temporarily depending on the application. A permanent application may or may not involve adhering the tiles to the floor in some way, whereas a temporary application may simply involve setting the tiles on the floor. Floor tiles are often horizontally interconnected to one another to cover large floor areas such as a garage, display areas or work space.

Floor tiles can be manufactured in a variety of shapes and patterns. In some examples, floor tiles are equipped with special surface patterns or structures to provide various utilitarian or superficial characteristics. For example, diamond steel patterns have been used to provide increased surface traction on the tiles and to provide a desirable aesthetic appearance.

Floor tiles are often used in work spaces, such as manufacturing plants. In such settings, the floor tiles are often exposed to debris and/or liquid. Buildup of such debris and/or liquid on top of the tile can reduce the effectiveness of the tile. Further, debris and liquid that is allowed to gather under the tile can also be problematic. Thus, there is a need to provide a floor tile support system that prevents accumulation of debris and/or liquid while simultaneously providing a structurally sound and ergonomically suitable support system.

SUMMARY

According to some aspects of the present disclosure, a floor tile includes a plurality of ribs defining an upper surface of the floor tile, each rib comprising a flat top configured to be parallel with a floor, wherein a thickness of each rib tapers toward the flat top.

The flat top of the rib and a sidewall of the rib can form an obtuse angle. In some examples, at least a portion of the plurality of ribs are concentric. The rib can be shaped to prevent liquid from gathering on the upper surface. The floor tile can include a coupling element disposed proximate an edge of the floor tile, the coupling element can attach to a corresponding coupling element on a corresponding tile. The plurality of ribs can be spaced apart such that the floor is at least partially exposed through the tile. The plurality of ribs can extend non-parallel to the edges of the floor tile. In some examples, the floor tile includes an underside that is configured to contact the floor, such that the plurality of ribs extend upward from the underside. The upper surface and the underside can be integrally formed. The underside of the floor tile can include a plurality of struts. The plurality of struts can have varying thicknesses.

In some examples, each rib comprises a strut extending from a base of the rib. At least a portion of the plurality of struts can run perpendicular to at least a portion of the plurality of ribs. The plurality of struts can include a plurality of raised portions configured to contact the floor. The plurality of raised portions can define drainage channels in the underside of the floor tile.

In some examples, a modular floor mat includes a set of interlocking tiles, each tile can include a top surface, a bottom surface, a plurality of ribs positioned on the top surface. Each of the ribs can include a flat top positioned at a proximal end of the rib, a base position at a distal end of the rib, the base having a width that is greater than a width of the flat top, and a sidewall extending between the flat top and the base. The sidewall can be curved.

In some examples, each rib has a tapering thickness that narrows near the flat top. Each of the ribs can be configured to abut a corresponding rib on a corresponding tile. Each tile of the set of interlocking tiles can include a width of between 16 and 20 inches, and a length of between 16 and 20 inches. The flat top and sidewall of each rib can be configured to increase surface traction of the tile. The flat top comprises a surface area sufficient for load bearing of static and dynamic heavy loads.

The foregoing and other features, utilities, and advantages of the invention will be apparent from the following detailed description of the invention with reference to the accompanying drawings.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The present disclosure relates generally to supportive floor tiles. The floor tiles can be configured for use in manufacturing plants, production lines, assembly lines, CNC machines, individual workstations, custom work platforms, etc. The floor tiles can be intended to support humans, vehicles, and machinery. The floor tiles can form a mat or floor panel that is assembled from modular tiles configured to connect with one another.

Conventional floor mats come in a variety of shapes, sizes, and configurations. Some floor mats are configured as a single unitary piece. A unitary piece can simplify the installation process, however, unitary mats are often heavy, non-customizable, and difficult to install on a large scale. Modular mats can be made of multiple tiles that connect to form a larger unit. Modular configurations can be assembled and positioned in locations where a unitary mat could not, such as large areas, around corners and long aisle solutions.

These and other examples are discussed below with reference to FIGS. 1-6. However, a person of ordinary skill in the art will readily appreciate that the detailed description given herein with respect to these figures is for explanatory purposes only and should not be construed as limiting.

Figure 1:
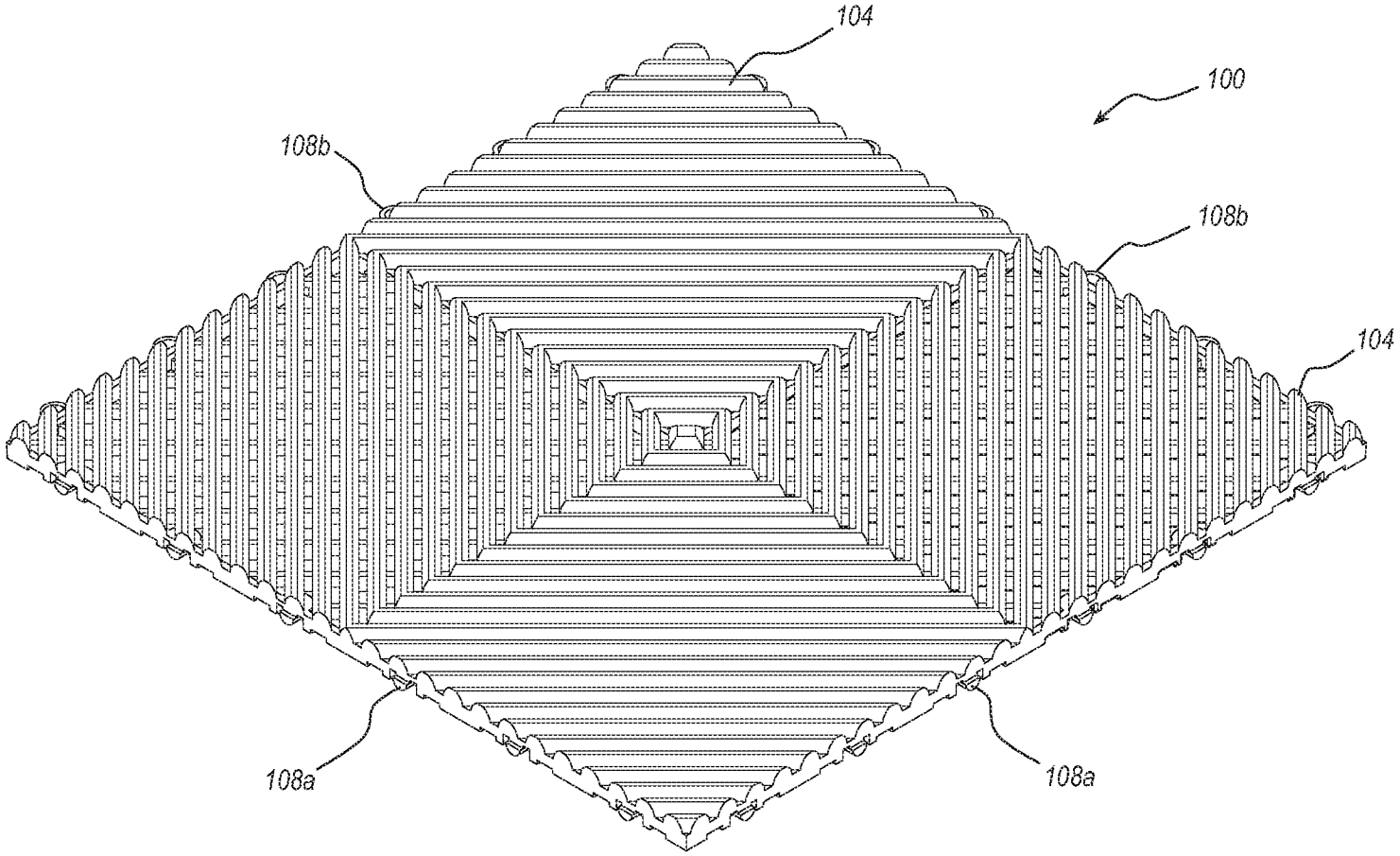
FIG. 1 shows a top perspective view of a tile.

FIG. 1 illustrates a top perspective view of a floor tile 100. The tile 100 can be made from durable rubber or polymer compounds that can be rigid and/or flexible. In some examples, the tile 100 can be made from specialized rubber compounds for general purpose applications, resistance to industrial oils, ESD static dissipative and fire retardant applications. In some examples, the tile 100 is generally rigid while comprising one or more flex points or axis about which the tile 100 can bend or flex.

The tile 100 can be manufactured using an injection molding process. The tile 100 is shown as a square, however, other shapes are possible (e.g., triangle, rectangle, pentagon, hexagon, circular, ellipsoidal etc.). In some examples, the tile 100 can be approximately 18×18 inches. In some examples, the tile can comprise a width of between 16 and 20 inches, and a length of between 16 and 20 inches.

The tile 100 can further include traction elements on its top surface, such as ribs 104. The ribs 104 defining the top surface can provide traction while still allowing easy twist and turn maneuvers for freedom of movement in dynamic workstations. As will be discussed in greater detail below, the ribs 104 can be configured to prevent buildup of liquid or debris on the top surface of the tile 100.

The ribs 104 can define the top surface of the tile 100 and can be configured to support workers or machinery. The ribs 104 can be substantially similar in thickness and yet have varying length. In some examples the ribs 104 are concentric, such that the ribs 104 radiate outward from the center of the tile 100. The ribs 104 can define annular or rectangular concentric rings. The tile 100 can include a number of edges configured to abut corresponding edges on corresponding tiles. In some examples, the edges of the tile 100 can be substantially straight. Each edge can include one or more tabbed portions 108*a* and one or more receiving portions 108*b*. The receiving portions 108*b* can comprise female engagement mechanism configured to receive and couple with the tabbed portions 108*a*. For example, the tabbed portions 108*a* can comprise protrusions configured to be received into the female portion 108*b*. In some aspects, there can be multiple tabbed portions 104 and multiple indented portions 108 along each edge of the tile 100. The tabbed portions 108*a* and the receiving portions 108*b* can be configured as interlocking elements. It will be understood that any suitable engagement mechanism is contemplated for use with the tile 100.

In some examples, the floor tile 100 can be divided into different sections. For instance, the tile 100 can be segmented into four distinct quarters or quadrants. As illustrated, the ribs 104 can change their longitudinal direction in each of the quadrants. For example, the ribs 104 in each section of tile 100 can run at a 45 degree angle relative to the edges of that particular section of the tile 100. This can produce a distinctive checkered pattern. Further details of the tile 100 are provided below with reference to FIGS. 2-5.

Figure 2:
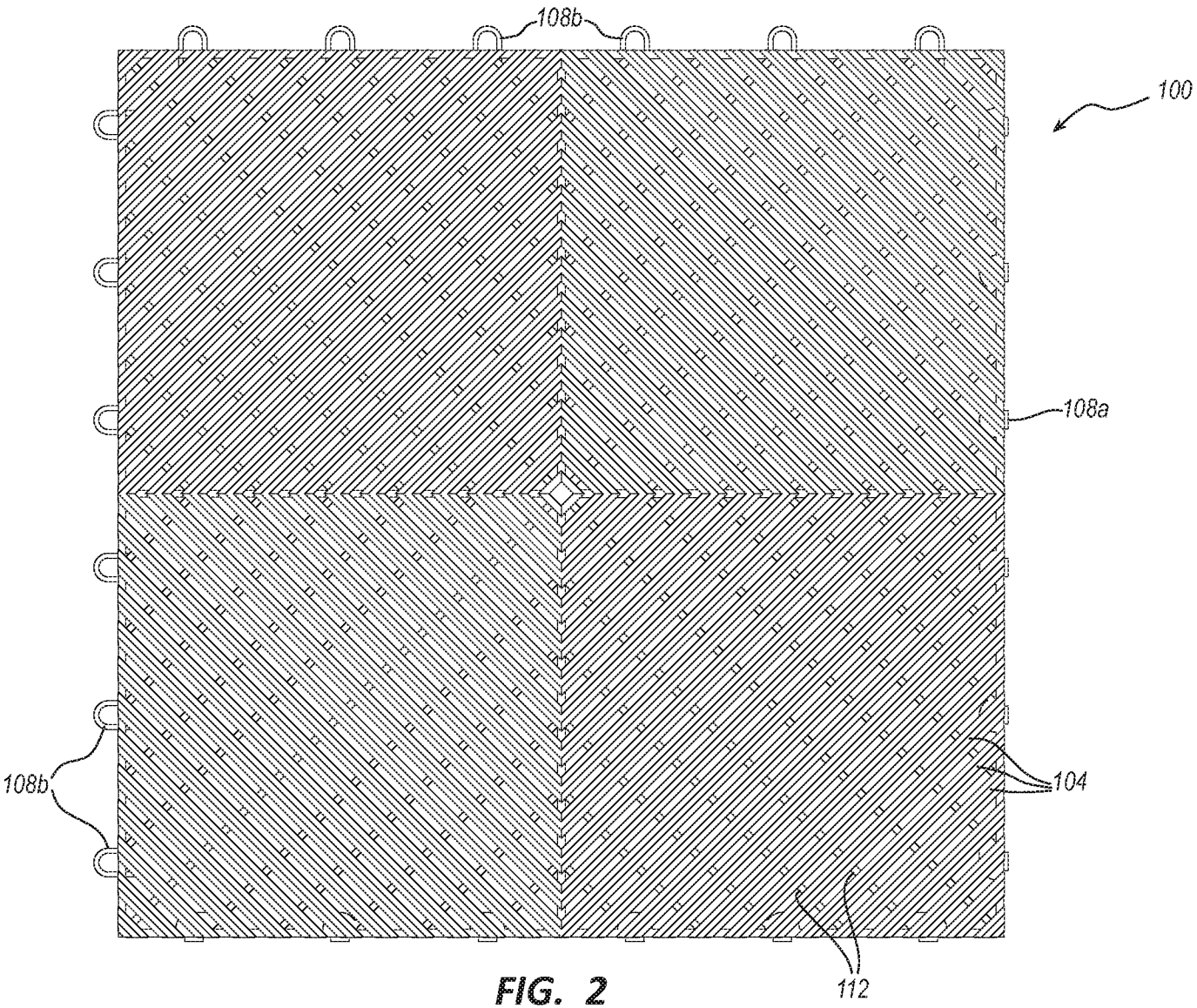
FIG. 2 shows a top view of the tile of FIG. 1.

FIG. 2 illustrates a top view of the tile 100. In addition to the support ribs 104 and the engagement features 108*a* and 108*b*, the tile 100 can include struts 112 that run beneath the support ribs 104. In some examples, the ribs 104 can be spaced such that a gap exists between each adjacent rib 104. The gaps between the ribs 104 can allow liquid or other debris to pass between the ribs 104 to prevent a buildup of water or debris on the top surface of the tile 100. The gaps between the ribs 104 can also allow visibility of the underlying floor beneath the tile 100. In some examples, the distance between the ribs 104, in combination with the height of the ribs 104, provides effective water drainage while also minimizing subfloor visibility. It will be understood that the distance between the ribs 104 can be adjusted or customized depending on the user's needs.

Likewise, the struts 112 can be spaced such that gaps exists between adjacent struts 112. The gaps between the struts 112 can allow liquid or other debris to pass between the struts 112 onto the subfloor. This helps to prevent a buildup of water or debris in the tile 100. The gaps between the struts can also allow visibility of the underlying floor beneath the tile 100. In some examples, the separation of the ribs 104 is less than the separation of the struts 112. The struts 112 can have varying thicknesses. For instance, the struts 112 can alternate between greater and lesser thicknesses. Further details of the struts 112 are provided below with reference to FIGS. 4 and 5.

Figure 3A:
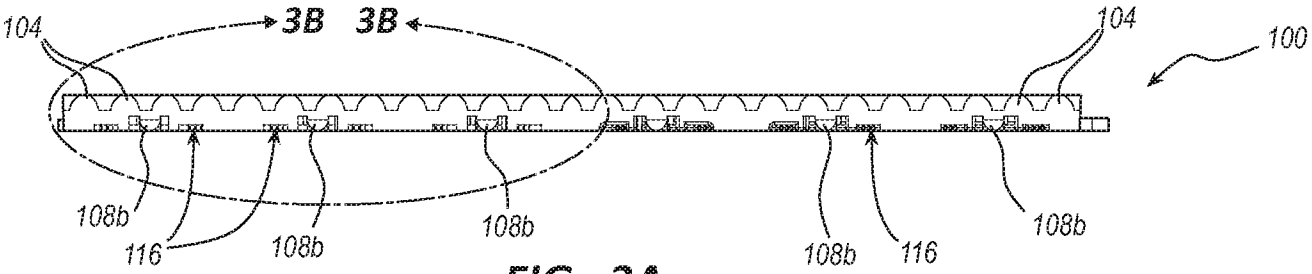
FIG. 3A shows a side view of the tile of FIG. 1.
Figure 3B:
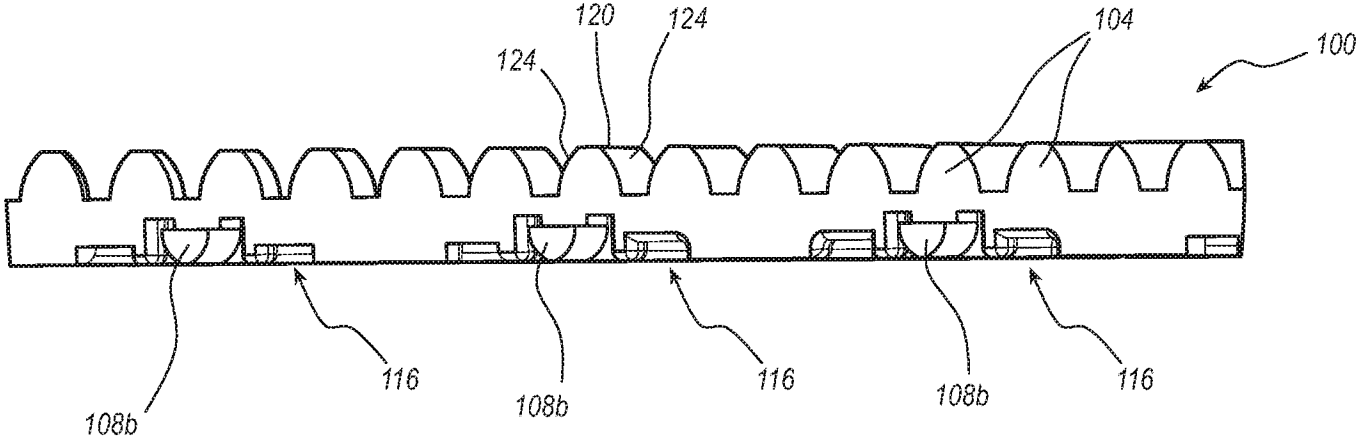
FIG. 3B shows a close-up side view of the tile of FIG. 3A.

FIG. 3A illustrates a side view of the tile 100 including the ribs 104 and engagement features 108*b*. According to some examples, the bottom surface of the tile 100 can define channels 116 that run underneath the tile 100. The channels 116 can be recessed portions that provide pathways for runoff. FIG. 3B illustrates a close-up view of the tile 100. In some examples, the channels 116 are at least partially formed or defined by the struts 112 that run underneath the tile 100.

In some examples, the ribs 104 can include a flat top 120 configured to come into direct contact with the person or item being supported. The ribs 104 can further include curved or tapering sidewalls 124 that extend from the flat top 120. The sidewalls can converge as they extend toward the flat top 120. The sidewalls can be planar or curvilinear. The flat top 120 can be configured to be parallel with the floor. Each of the sidewalls 124 can form an obtuse angle with the flat top 120 of the rib 104. In some examples, the flat top 120 and the portion of the sidewall 124 that is immediately adjacent to the edge of the flat top 120 can form an angle between 90 degrees and 180 degrees. In other words, the sidewalls 124 can be oblique to the flat top 120. The thickness of the ribs 104 can taper toward the flat top 120, that is, the base of the rib 104 is wider than the flat top 120 such that when approaching the flat top 120 the rib 104 narrows. The configuration of the flat top 120 and the sidewalls 124 increases wet weather traction by transitioning into a specific taper to decrease the surface tension so that liquid will effectively wet off and not affect traction.

The floor tile 100 includes edges or ends positioned along the perimeter of the tile 100. The edges can extend along the periphery of the bottom surface of the tile 100. In some examples, the edges are shaped substantially similar to the struts 112 (i.e., comprising a series of recesses and raised portions). In some examples, recesses in the edges of the tile 100 at least partially define the channels 116. Further details of the tile 100 are provided below with reference to FIGS. 4 and 5.

Figure 4:
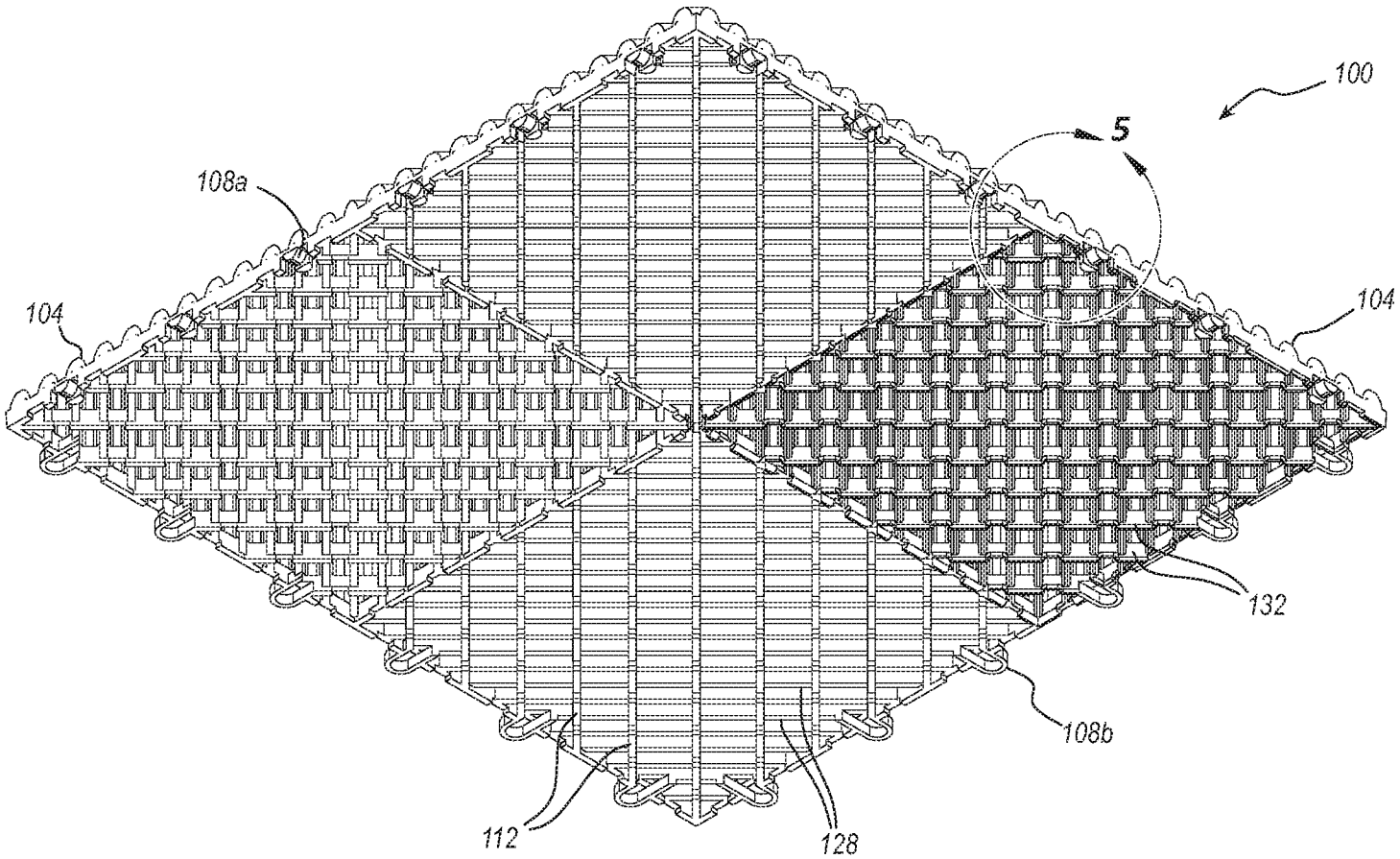
FIG. 4 shows a bottom perspective view of a tile.

FIG. 4 illustrates a bottom perspective view of the tile 100, revealing a bottom surface of the tile 100. In some examples, the top surface and the bottom surface of the tile 100 are integrally formed. The bottom surface of the tile 100 can include raised or embossed portions 132 that are configured to contact directly the floor to support the tile 100. Each strut 112 can define a plurality of raised portions 132. The channels 116 can be positioned or defined between each of the raised portions 132. In some examples, the raised portions 132 run parallel to one another. As discussed in greater detail below, the tile 100 can further include crossbars 128 that provide structural support to the tile 100.

Figure 5:
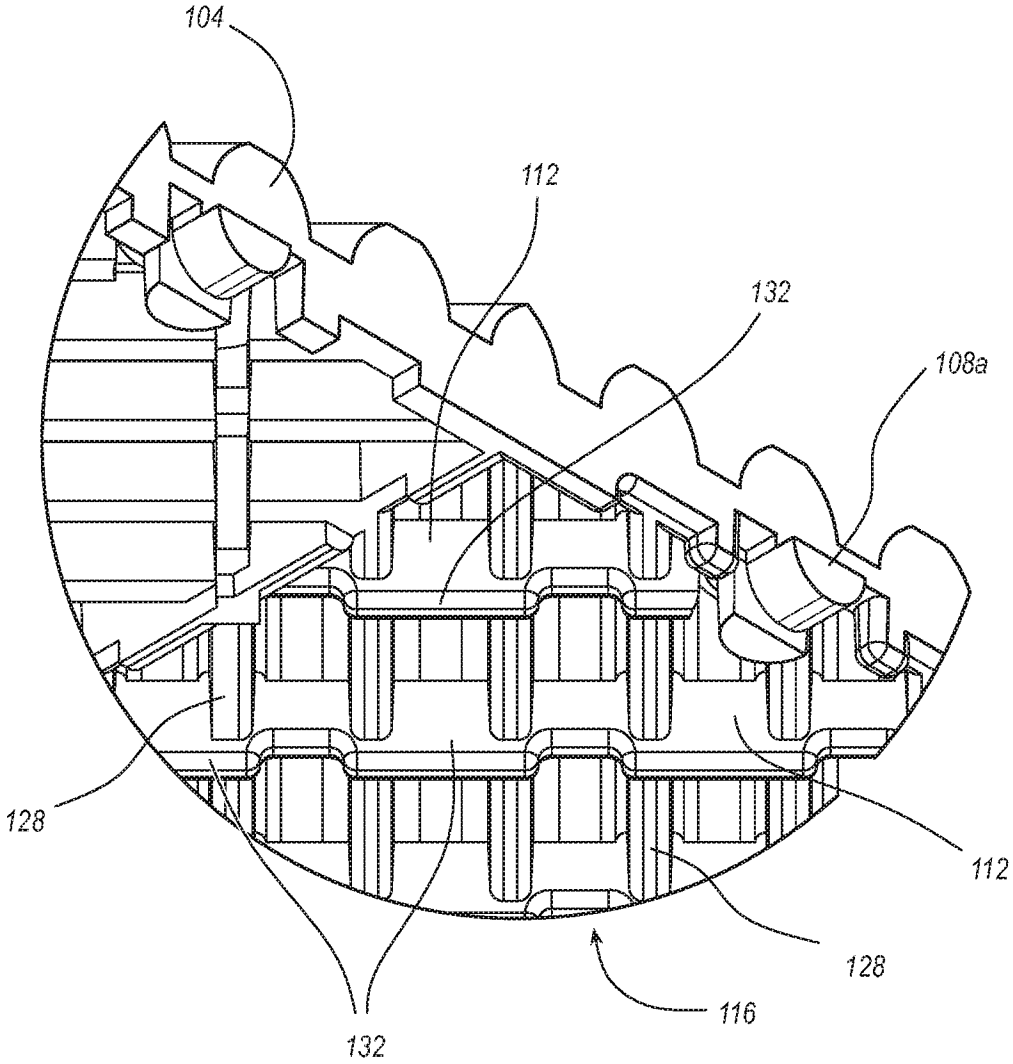
FIG. 5 shows a close-up bottom perspective view of the tile of FIG. 4.

FIG. 5 illustrates a close up view of the bottom surface of the tile 100. As shown, the bottom surface can be defined by the struts 112 including the raised portions 132 and channels 116 and additionally by crossbars 128 which run perpendicular to the struts 112. The crossbars 128 can be spaced to provide gaps or drainage pathways for liquid and allow for air to circulate throughout the flooring system. In some examples, the crossbars 128 do not come into contact with the floor. That is, the crossbars 128 are slightly recessed when compared to the raised portions 132. In some examples, the crossbars 128 extend from a base of the ribs 104. The ribs 104 and the crossbars 128 can be integrally formed. The crossbars 128 can have a thickness that is less than the thickness of the base of the ribs 104. Details of how floor tiles, such as floor tile 100, can be used to create a modular interlocking floor mat are provided below with reference to FIG. 6.

Figure 6:
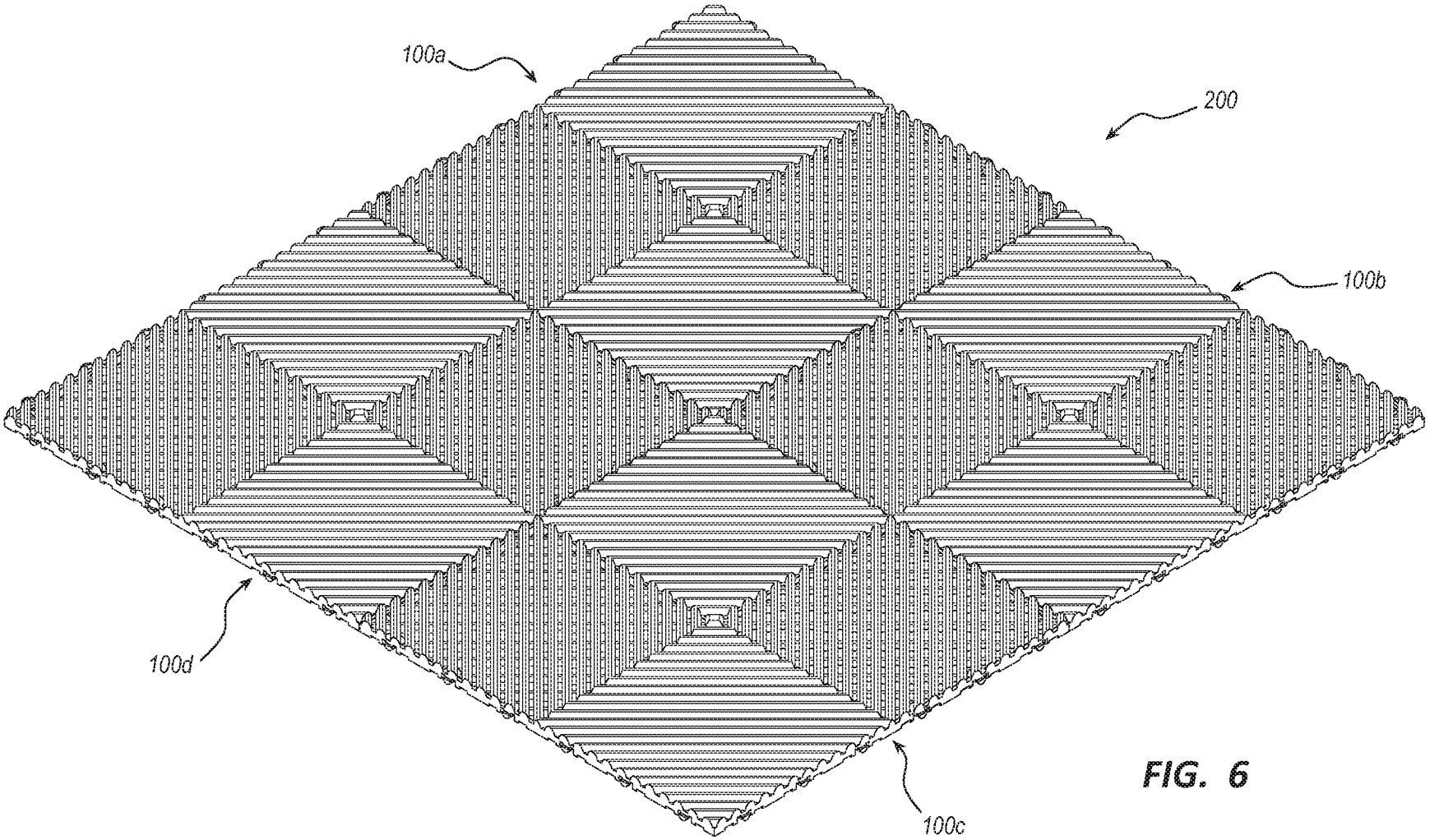
FIG. 6 shows a perspective view of a set of interlocking tiles.

FIG. 6 illustrates a floor panel or mat 200. In some examples, the floor panel 200 can include modular interlocking tiles 100*a*, 100*b*, 100*c*, 100*d*. The modular interlocking tiles 100*a*-100*d* can be substantially similar to the floor tile 100 discussed above with reference to FIGS. 1-5. Each of the tiles 100*a*-100*d* can include ribs configured to abut corresponding ribs on a corresponding tile. The ribs from corresponding tiles can abut at a 45 degree angle and can form a seamless or continuous appearance such that it is not readily apparent where one tile ends and another begins.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, the methods described may be performed in an order different from that described, and various steps may be added, omitted, or combined. Also, features described with respect to certain embodiments may be combined in other embodiments.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including" and "having" come as used in the specification and claims shall have the same meaning as the term "comprising."

What is claimed is:

1. A floor tile comprising:

a plurality of ribs defining an upper surface of the floor tile, each rib comprising a flat top configured to be parallel with a floor;

a plurality of struts defining an underside of the floor tile, each strut comprising a plurality of raised portions configured to contact the floor;

wherein a thickness of each rib tapers toward the flat top; and wherein the plurality of ribs are concentrically arranged.

2. The floor tile of claim 1, wherein the flat top of the rib and a sidewall of the rib form an obtuse angle.

3. The floor tile of claim 1, wherein the rib is shaped to prevent liquid from gathering on the upper surface.

4. The floor tile of claim 1, further comprising a coupling element disposed proximate an edge of the floor tile, the coupling element configured to attach to a corresponding coupling element on a corresponding tile.

5. The floor tile of claim 1, wherein the plurality of ribs are spaced apart such that the floor is exposed through the tile.

6. The floor tile of claim 1, wherein the plurality of ribs extend non-parallel to the edges of the floor tile.

7. The floor tile of claim 1, further comprising an underside that is configured to contact the floor, wherein the plurality of ribs extend upward from the underside.

8. The floor tile of claim 7, wherein the upper surface and the underside are integrally formed.

9. The floor tile of claim 1, wherein the plurality of struts have varying thicknesses.

10. The floor tile of claim 1, wherein each strut extends from a base of a corresponding rib.

11. The floor tile of claim 1, wherein at least a portion of the plurality of struts run perpendicular to at least a portion of the plurality of ribs.

12. The floor tile of claim 1, wherein the plurality of raised portions define drainage channels in the underside of the floor tile.

13. A modular floor mat comprising:

a set of interlocking tiles, each tile comprising:

a top surface;

a bottom surface;

a plurality of ribs positioned on the top surface, each of the ribs comprising:

a flat top positioned at a proximal end of the rib;

a base position at a distal end of the rib, the base having a width that is greater than a width of the flat top;

a sidewall extending between the flat top and the base; and a strut extending from the base and running perpendicular to the rib, the strut comprising a plurality of raised portions configured to contact a floor, the raised portions defining drainage channels in the bottom surface of the tile.

14. The modular floor mat of claim 13, wherein the sidewall is curved.

15. The modular floor mat of claim 13, wherein each rib has a tapering thickness that narrows near the flat top.

16. The modular floor mat of claim 13, wherein each of the ribs is configured to abut a corresponding rib on a corresponding tile.

17. The modular floor mat of claim 13, wherein each tile of the set of interlocking tiles comprises a width of between 16 and 20 inches, and a length of between 16 and 20 inches.

18. The modular floor mat of claim 13, wherein the flat top and sidewall of each rib is configured to increase surface traction of the tile.

19. The modular floor mat of claim 13, wherein the flat top comprises a surface area sufficient for load bearing of static and dynamic heavy loads.

* * * * *